United States Patent [19]

Morizzo

[11] Patent Number: 4,489,900

[45] Date of Patent: Dec. 25, 1984

[54] APPARATUS FOR AUTOMATICALLY CUTTING AND WINDING SHEET MATERIAL

[75] Inventor: Nicholas L. Morizzo, Cornwall, N.Y.

[73] Assignee: Krantz America, Inc., Charlotte, N.C.

[21] Appl. No.: 518,962

[22] Filed: Aug. 1, 1983

[51] Int. Cl.[3] ..... B65H 19/20; B65H 19/28

[52] U.S. Cl. ..... 242/56 R; 83/424

[58] Field of Search ..... 242/56 R, 56 A, 67.1 R, 242/56.6; 83/156, 349, 424

[56] References Cited

U.S. PATENT DOCUMENTS

| | | | |
|---|---|---|---|
| 3,272,043 | 9/1966 | Ryan | 83/156 |
| 3,721,396 | 3/1973 | Morizzo | 242/56 R |
| 3,756,526 | 9/1973 | Bassett et al. | 242/56 R |
| 4,360,170 | 11/1982 | Kuklies et al. | 242/56 R |

*Primary Examiner*—Stuart S. Levy
*Assistant Examiner*—Lloyd D. Doigan
*Attorney, Agent, or Firm*—Richards, Shefte & Pinckney

[57] ABSTRACT

Apparatus for feeding a traveling sheet of fabric material to one receiver roll for winding thereon until it is full, and then cutting the fabric and feeding it onto another receiver roll without interruption of the fabric travel. The apparatus includes a carriage for movement from one receiver roll to another, and pivoted arms mounted on the carriage for movement toward and away from the receiver rolls during movement of the carriage and during the time the receiver rolls are being wound. Driven feeder rollers are mounted on the arms in spaced relation to define a predetermined path of movement for the fabric directed toward a receiver roll, and a cutting element is disposed intermediate the driven feeder rolls to selectively cut the fabric when a full package has been wound on one receiver roll, and fabric directing means are provided to assure that the cut edge of the traveling fabric is guided along its path of movement to the receiver roll for winding thereon.

16 Claims, 3 Drawing Figures

APPARATUS FOR AUTOMATICALLY CUTTING AND WINDING SHEET MATERIAL

BACKGROUND OF THE INVENTION

In forming and processing sheet material, such material is generally conveyed in an open or flat disposition through various processing steps, after which predetermined lengths of the material are wound onto reusable cores for storage and shipping. For example, in the textile industry, it is common practice to imprint a design onto a traveling length of fabric, and then convey the fabric through a tenter frame in which it is heated to promote drying of the dyes, after which the fabric is wound onto a receiving or storage roll and cut when a predetermined length of the fabric has been wound onto the core. During this processing and winding of the fabric, it is being conveyed continuously at very high speeds, sometimes in excess of one hundred yards per minute, and difficulties are often encountered in carrying out the various steps required by the processing cycle without interrupting the rapid rate of travel of the fabric being processed.

Thus, in equipment presently utilized to cut and wind fabric material being delivered from a tenter frame or similar source, a frame is provided to extend above a pair of trucks, each of which carries a core onto which the fabric is to be wound. The frame is provided with an arm member that is selectively movable on the frame so as to be alternatively positionable above one or the other of the trucks, and the arm member is also mounted on the frame for selective pivotal movement about a horizontal axis so that the extending end of the arm can be disposed in surface contact with the core of one or the other of the trucks and can gradually pivot upwardly as the material is wound onto the core and the diameter thereof increases. The frame and the arm are provided with a system of rolls by which the fabric is guided and conveyed to the core.

In using this conventional equipment, the fabric is wound onto one of the cores until it contains a predetermined length of the fabric, after which the equipment is automatically stopped by an appropriate switch, and an operator must then carry out a number of manual steps to prepare the equipment for winding fabric onto the other, empty core. Thus, the operator must first cut the fabric, which is now stopped, with a hand-held shearing device, and then pivot the arm member upwardly to clear the full core, move the arm member along the frame until it is positioned above the empty core, and then pivot the arm downwardly until the feed roll at the extending end thereof is positioned in surface contact with the empty core. The operator must next grab the cut edge of the fabric and manually wrap several turns of the fabric about the empty core, whereupon the equipment is again energized.

Even though the movement of the arm member is carried out by motors which are controlled by the operator, it will be appreciated that a considerable amount of time is consumed while the various steps are carried out by the operator, usually between thirty seconds and three minutes. During this time interval, the fabric continues to be fed to the winding equipment from the tenter frame at the above-described rapid feed rate, and it has therefore been necessary to utilize vary large cloth accumulator apparatus which accumulates the excess fabric during the time the winding equipment is being changed from the full core to the empty core.

This additional accumulator apparatus is quite expensive, and therefore adds significantly to the necessary costs involved in using the winding equipment. In some instances, accumulator apparatus is not utilized because of its costs, in which case the tenter frame must be stopped during the core change operation. Such stopping of the tenter frame not only results in low production each time a core is filled, but it can also result in the cloth being scorched while it is being retained within the tenter frame.

A further disadvantage inherent in aforesaid conventional winding equipment is the fact that the operator must grasp the edge of the cloth after it is cut so that it can be wrapped about the empty core, and it sometimes happens that the operator will lose his grasp on the fabric, with the result that the natural resiliency of the fabric will cause it to snap back in the direction of the tenter frame and to become unthreaded from the system of rolls through which it is fed. When this occurs, additional time is lost during rethreading of the fabric through the rolls to exacerbate further the problem of dealing with the fabric being fed from the tenter frame as discussed above.

To overcome the aforesaid drawbacks of conventional fabric winding equipment, the present invention provides for equipment of this type which automatically cuts the fabric and feeds it onto the empty core without any handling or cutting of the fabric by the operator, thereby permitting the core change to be facilitated quickly enough to avoid the need for using accumulator apparatus or for shutting down the tenter frame during the core changing operation.

BRIEF SUMMARY OF THE INVENTION

In accordance with the present invention, a frame is provided on which arms are mounted for selective movement toward and away from a core or receiver roll. First and second drive means are provided on the arms for causing the sheet of material to move along a predetermined path of movement toward the receiver roll, and an automatic cutting means is disposed on the arm between the first and second drive means to selectively cut the traveling material along an edge extending transversely of the direction of movement thereof. Engaging means are provided for selective movement to positively engage the sheet of traveling on both sides of said cutting means during the cutting of the material, and to direct the material along the aforesaid predetermined path of movement after the cutting thereof so that the cut edge of the material is fed onto the surface of the receiver roll.

In one embodiment of the present invention, the selectively operable engaging means include first and second conveyors, one of which engages the first drive means to hold the traveling material there between while directing it along the aforesaid predetermined path of movement, and the other of which is selectively movable to a position extending along such predetermined path of movement and against the second drive means to guide said material along said path of movement after it is cut to feed such material onto the receiver roll in one direction of rotation thereof.

In another embodiment of the present invention, the conveyor means engaging the second drive means is selectively movable to a position abutting the second drive means about a surface portion thereof to feed the traveling material onto the receiver roll in the opposite direction of rotation thereof.

In a third embodiment of the present invention, the sheet of material is normally guided about an idler roll carried on the movable arms, and a driven feeder roll is carried on the movable arm in spaced relation to the idler roll with the automatic cutting means disposed between the idler roll and the driven feeder roll, the driven feeder roll being disposed on the arms to engage the receiver roll to form a nip therewith when the arm is moved toward the receiver roll. A driven engagement roll is disposed adjacent to and normally spaced from the idler roll, and the idler roll is mounted on the arm for selective movement to an operative position at which the traveling material is positively engaged between the idler roll and the driven engagement roll just prior to the cutting of the traveling material by the automatic cutter. In this embodiment, the predetermined path of movement of the material is in a substantially vertical direction toward the receiver roll.

DESCRIPTION OF THE PREFERRED EMBODIMENTS

Figure 1:
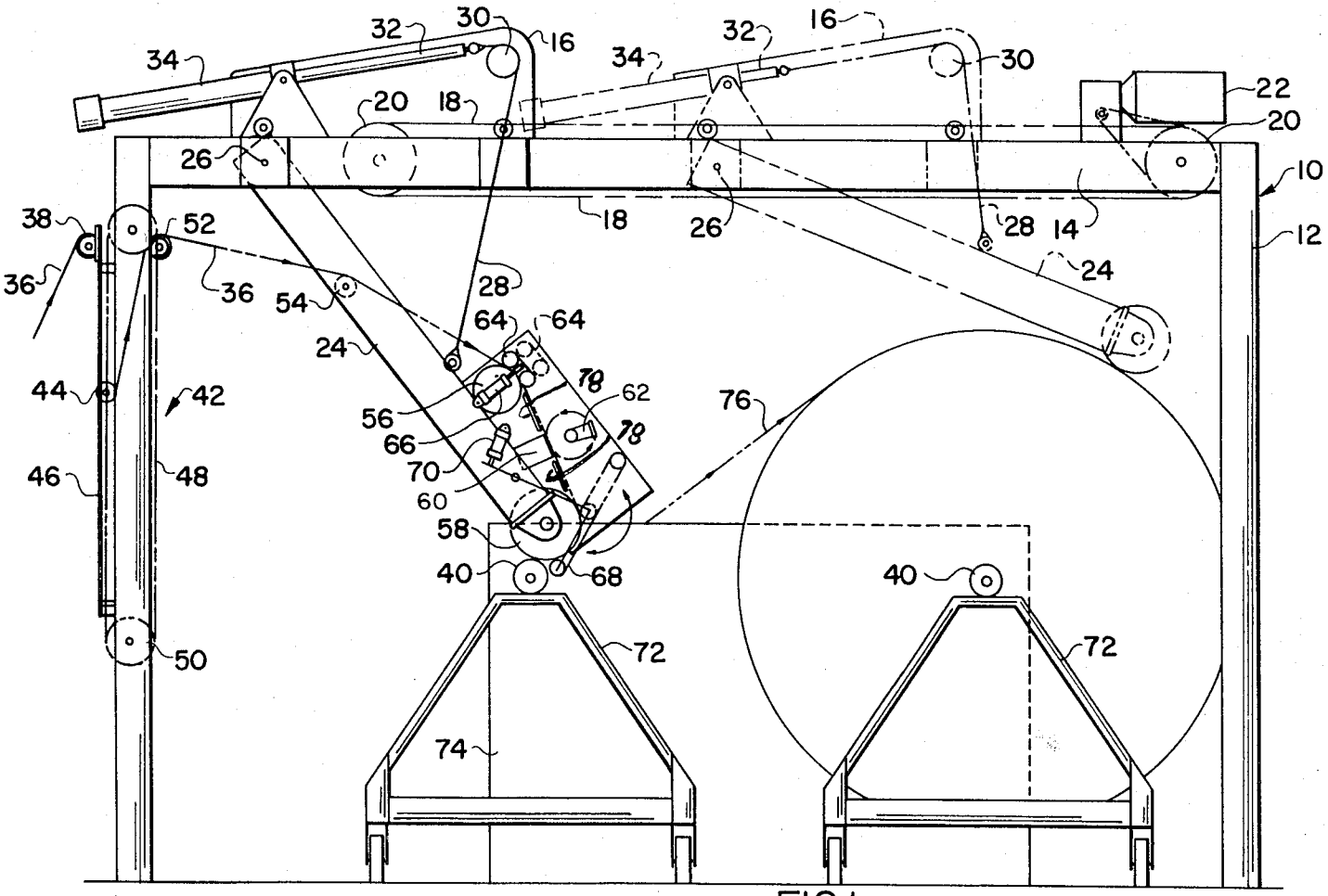
FIG. 1 illustrates, in diagramatic form, a frame and a movable arm means forming one embodiment of the present invention.

The first embodiment of the present invention is illustrated in FIG. 1, and it includes a frame 10 having a plurality of stanchions 12 supporting horizontal tracks 14 along which a conventional carriage 16 is arranged for movement by a chain 18 disposed about pulleys 20, the chains being selectively driven by a motor 22 to move the carriage 16 back and forth between the positions thereof shown in full lines and in phantom lines. A pair of parallel movable arms 24, one of which is visable in FIG. 1, are mounted on the carriage 16 by a pivot shaft 26, and a chain 28 is connected at one end thereof to an arm 24 with the other end of the chain 28 being connected to a sprocket 30 carried on the piston rod 32 of a pneumatic or hydraulic cylinder 34, the sprocket 30 acting to maintain the arms 24 in parallel. Movement of the arms 24 in a horizontal direction is controlled by movement of the carriage 16 along the tracks 14, and vertical movement of the arms 24 is controlled by the cylinder 34.

At one end of the frame 10, a wide sheet of fabric 36 is fed to the frame from a tenter frame or another known source (not shown), and passes over an idler roll 38 for delivery to conventional compensator apparatus 42 which adjusts the feed rate of the fabric as it is being wound onto the rotating receiver roll or core 40 to compensate for any surface speed variations of receiver roll 40 during winding. This compensator apparatus 42 is well-known in the art and briefly described, includes a floating dancer roll 44 arranged for vertical movement in a channel 46, the dancer roll 44 being carried on a chain 48 extending around a sprocket 50. As the speed of the traveling fabric 36 changes, the position of the dancer roll 44 is adjusted to move the chain 48, and one of the sprockets 50 operates a speed adjustment potentiometer (not shown) which controls the rotational speed of the driven, cloth engaging rolls on the arms 24 which will be described presently.

After leaving the dancer roll 44, the fabric 36 passes around an idler roll 52 on the frame 10, and is directed toward the arms 24. The arms 24 have another idler roll 54 disposed therebetween, and a first driven roll 56 and a second driven roll or batch roll 58 disposed between the extending end of the arm 24. Thus, the fabric 36 travels in a predetermined path of movement from the surface of the first driven roll 56 to the surface of the second driven roll 58, and around the second driven roll 58 toward the surface of the driven receiver roll 40. An automatic cutting device is mounted on the arms 24 at a position between the driven rolls 56, 58, such cutting device including a cutting plate 60 and a rotatable cutting element 62 which is operated by a drive motor with clutch and brake (not shown) to make one revolution during its cutting stroke so as to cut the traveling fabric 36 along en edge extending transversely of the direction of travel of the fabric between the driven rolls 56, 58. This cutting device is disclosed in greater detail in U.S. Pat. No. 3,721,396, and in its application in the present invention, the cutting element 62 is rotated, during its cutting stroke, at a surface speed corresponding to the speed of the traveling fabric 36 to provide a clean cut without interferring with the normal movement of the fabric 36.

A short conveyor belt 64 is mounted on the arms 24 for selective movement under the control of a solenoid 66 between a first position at which it is spaced from the surface of the first driven roll 56 (shown in phantom lines in FIG. 1), and a second position at which one reach of the conveyor belt 64 positively engages the fabric 36 between it and the surface of the first driven roll. The location and extent of the conveyor belt 64 is such that, at its second or operative position, the fabric 36 leaving the conveyor belt 64 is guided or directed along the aforesaid predetrmined path of movement of the fabric 36. A second conveyor belt 68 is operated by a solenoid 70 to move between a first position at which the reaches thereof are spaced from the second drive roll 58 (shown in phantom lines in FIG. 1), and a second position at which one reach extends around a substantial arcuate portion of the second driven roll 58, so that the fabric is positively engaged therebetween and, when leaving the second conveyor 68, is directed toward the surface of the receiver roll 40.

The basic purpose of the apparatus described above is to first build a full package of material on one of the receiver rolls 40, then move the arm 24 to a position adjacent an empty receiver roll 40, cut the fabric, and begin winding the fabric on the empty receiver roll 40, all automatically and without any interruption of the fabric during these operations. In FIG. 1, arms 24 are shown in phantom lines at the position they would assume just prior to a full fabric packing being wound on the right receiver roll 40. At this point, a control panel 74 is energized to operate the cylinder 34 which lifts the arms 24 sufficiently to clear the full package, and to operate the motor 22 which moves the carriage 16 and the arms 24 to the left, after which the cylinder 34 is again operated to lower the arms 24 to the full line position as shown in FIG. 1 with the second driven roll 58 in contact with the empty receiver roll 40. It will be noted that during this movement of the carriage 16 and the arms 24, fabric continues to be wound upon the right hand receiver roll 40 as indicated, in part, by the partial fabric line 76. When the arms 24 are disposed at the position shown in full lines in FIG. 1, the control panel 74 is energized to operate solenoids 66, 70 which move the first and second conveyor 64, 68 into abutment with the first and second driven rolls 56, 58, as shown in full lines in FIG. 1, so that the traveling fabric is positively engaged between the driven rolls 56, 58 and the conveyors 64, 68, respectively. The control panel 74 then operates the cutter element 62 which cuts cleanly the traveling fabric as described above, and the portion of the fabric beneath the cut is drawn by the right-hand receiver roll 40 to complete that package. The cut edge of the traveling fabric continues to be fed by the first driven roll 56 and the first conveyor 64 along the aforesaid predetermined path of movement of the fabric until the fabric reaches the nip formed between the second driven roll 58 and the second conveyor 68 where it is engaged thereby, fed around the surface of the driven roll 58 and directed toward the nip formed between the second driven roll 58 and the empty receiver roll 40, which is being driven in a counter-clockwise direction of rotation. The receiver roll 40 may have a roughened surface, or have an adhesive substance thereon, to assist in winding the fabric thereon. If desirable or necessary, guide plates 78 may be mounted to the arms 24 on each side of the cutting plate 60 to assist in guiding the fabric along its predetermined path of movement after it has been cut. Once the fabric begins to wind onto the empty receiver roll 40, the conveyors 64, 68 are returned by the control panel 74 to their original positions shown in phantom lines, and the fabric continues to be wound onto the receiver roll 40 with the arms 24 pivoting upwardly about its pivot shaft 26 until the left-hand package is substantially full, whereupon the abovedescribed cycle is repeated to move the arms 24 and the carriage to the right to engage the right hand receiver roll 40, which will be empty and ready for filling.

Figure 2:
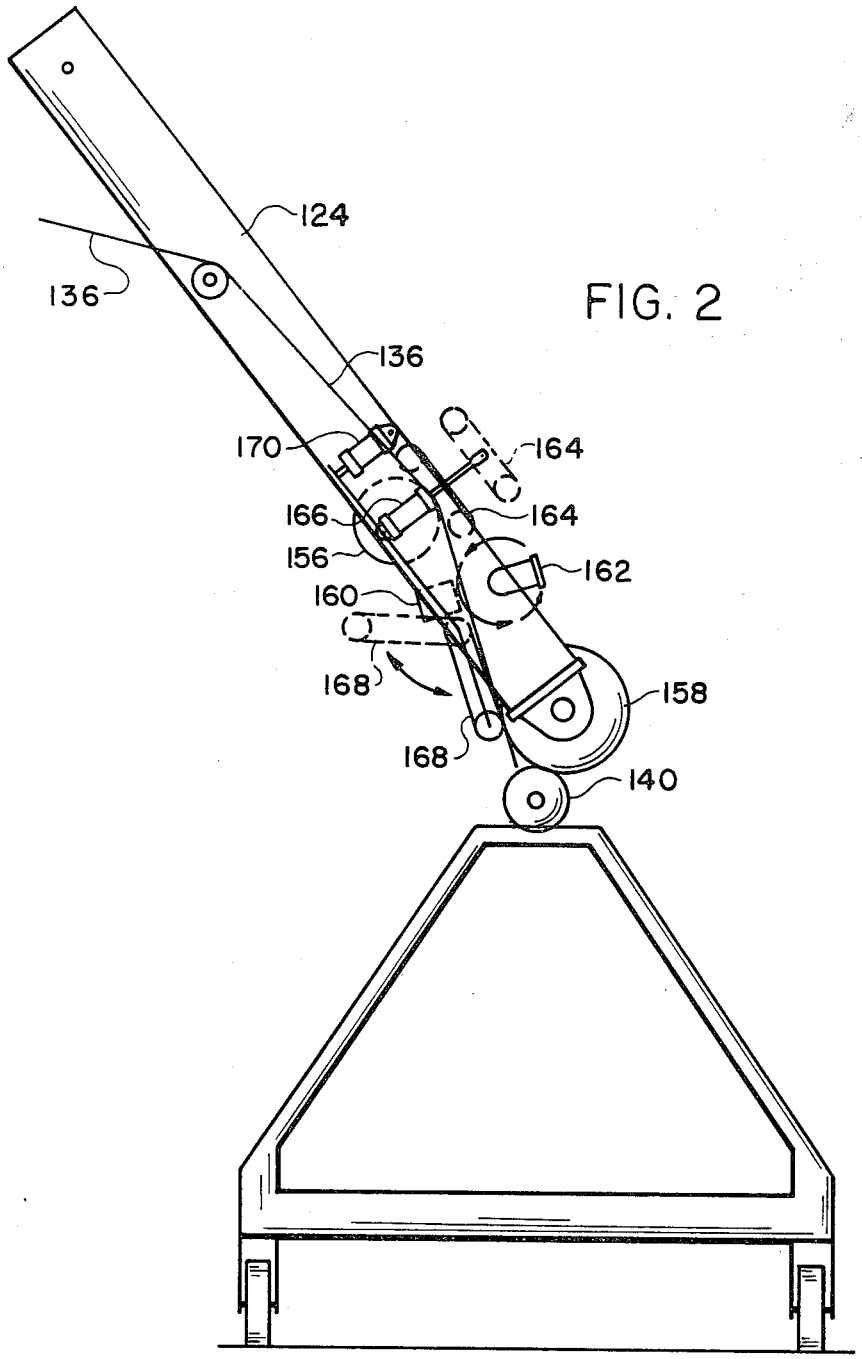
FIG. 2 illustrates, in diagramatic form, a modified arrangement of the movable arm means forming a second embodiment of the present invention.

It will be noted that at the time the travelling fabric is cut by the cutter element 62, the fabric is held in tension for such cutting by the positive engagement between the driven rolls 56, 58, and the conveyors, 64, 68, respectively, so as to enhance the cleanness of the cut. Moreover, since the fabric, during its travelling motion, is always under some tension, the end of the fabric above the cut would tend to fly back toward the compensator so as to require rethreading of the fabric and down time for the apparatus. However, since the fabric is held in positive engagement between the driven roll 56 and the conveyor 64, it will be held against its tendency to fly back, and will instead be directed along its predetermined path of movement. Thus, as indicated above, the apparatus of the present invention provides for an automatic transfer of the feed from a full receiver roll to an empty receiver roll without any interruption of the travel of the fabric and without any manual handling of the fabric or the apparatus. A second embodiment of the present invention is illustrated in FIG. 2 which shows a modified arm 124 which would be substituted for the arm 24 in the apparatus shown in FIG. 1. In this embodiment, the arm 124 is designed to feed the fabric onto an empty receiver roll 140 which would be driven in a clockwise direction of rotation rather than in the counter-clockwise direction of the empty roll 40 in FIG. 1. The arm 124 includes a first driven roll 156 selectively engaged by a first conveyor 164 movable by solenoid 166 between an operative or engaging position as shown in full lines, and a second piston spaced from driven roll 156 as shown in phantom lines. A second driven roll 158 is disposed at the end of the arm 124 and a second conveyor 158 is selectively movable by a solenoid 170 between an inoperative position shown in phantom lines and an operative position shown in full lines. It will be noted that at the operative position of the second conveyor 168, one of its reaches is disposed along the predetermined path of movement on the fabric 136 to guide and move the fabric 136 therealong, toward the surface of the empty receiver roll 140. A cutting element 162, identical to the cutting element 62 in FIG. 1, is disposed along the predetermined path of the movement of the fabric and between the driven rolls 156,158. The arms 124 are operated in a substantially similar manner to that described above in connection with FIG. 1 so that they will be moved from a substantially full receiver roll to an empty receiver roll 140, whereupon the solenoids move the conveyors 164, 168 to positively engage the fabric, and the fabric is cut by cutting element 162. The cut edge of the fabric is then guided along its predetermined path of movement until it reaches the empty receiver roll 140 at a point adjacent the nip formed with driven roll 158 where it will be wound upon the receiver roll 140 as it is driven in a clockwise direction. It will be apparent that the advantages obtained from the apparatus of FIG. 1, as discussed above, will also be obtained from the modified embodiment shown in FIG. 2.

Figure 3:
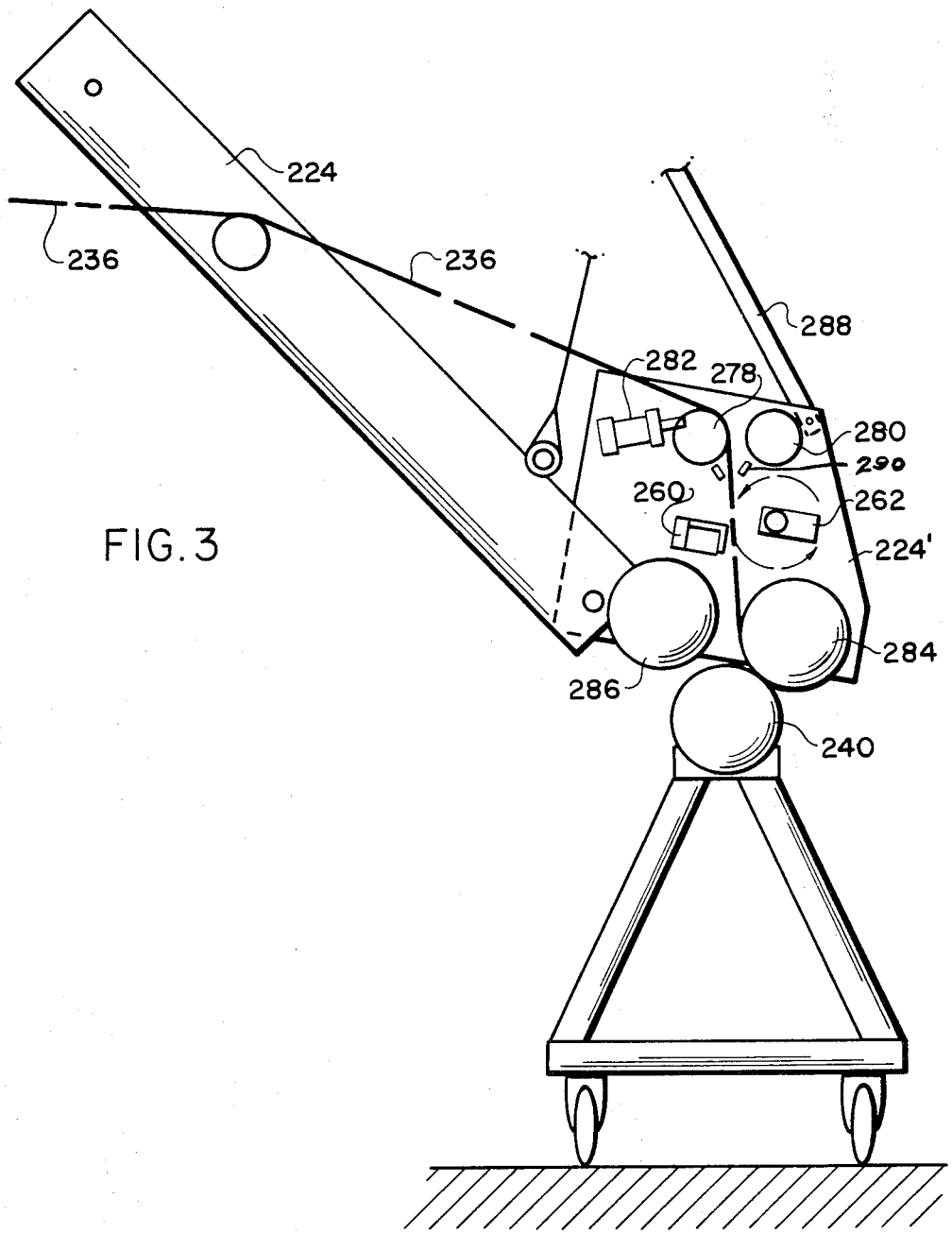
FIG. 3 illustrates, in diagramatic form, a further modified movable arm means forming a third embodiment of the present invention.

A third embodiment of the present invention is shown in FIG. 3 which illustrates modified arms 224 usable with the remaining portions of the apparatus shown in FIG. 1. The arms 224 includes a superstructure 224' having an idler roll 278 mounted thereon and a driven engagement roll 280 adjacent to but normally spaced from the idler roll 278 which is selectively movable by a solenoid 282 from its normal, spaced position to an operative position against the driver roll 280 to positively engage the fabric 236 threbetween. A driven feeder roll 284 is carried in the superstructure 224' for contct with the surface of the empty receiver roll 240 as illustrated in FIG. 3, and a cutting element 262 and cutting plate 260 are also mounted in the superstructure for disposition between the driven engagement roll 280 and the driven feeder roll 284, such cutting element 262 being identical to the cutting element 62 described above. Finally, a third driven roll 286 is mounted in the superstructure 224' generally adjacent to, but spaced from, the feeder roll 284.

In the operation of the embodiment shown in FIG. 3, the arms 224 are moved from the substantially full package to a position at which the feeder roll 284 is in contact with or closely adjacent the empty receiver roll 240, it being noted that during such movement the traveling fabric 236 is directed around the third driven roll 286 to continue feeding the fabric to the substantially full package. Once the arms 224 are in position at the empty receiver roll 240, the solenoid 282 is operated to move the idler roll 278 toward abutment with the driven engagement roll 280, and then the cutting element 162 is operated to cut the fabric. It will be noted that at the position of the arms 224 as shown in FIG. 3, the engagement roll 280 is located almost directly above the feeder roll 284 so that the fabric 236 traveling therebetween is caused to move in a predetermined path of movement which is in a substantially vertical direction toward the nip formed by the feeder roll 284 when it is in contact with the receiver roll 240. As a consequence, the portion of the fabric 236 between the engagement roll 280 and the cutting element 262 will, after the cut, be hanging in a substantially vertical direction and will be driven in such direction by the engagement roll 280 and the idler roll 278. The cut edge of the fabric will therefore be moved directly toward the surface of the feeder roll 284 and into the nip formed by it and the receiver roll 240, whereby it will be immediately wound onto the receiver roll 240. Preferably, the initial surface speed of the receiver roll 240 is slightly higher (e.g. 10 percent) than the line speed at which the fabric is traveling (e.g. 200 yards per minute) to eliminate any tendency of the fabric to bunch up when it reaches this nip, and the receiver roll 240 may thereafter be controlled to rotate at a surface speed approximately the same as the line speed of the fabric. Additionally, the movement of the arms 224 may be controlled so that the feeder roll 284 is initially spaced slightly from the surface of the receiver roll 240 until the cutting element 260 is operated, after which the feeder roll 284 is moved into contact with receiver roll 240 by energizing motor 22 described in connection with FIG. 1.

Thus, the third embodiment of the present invention obtains all of the benefits and advantages of the present invention as described above, and additionally, the vertical path of movement of the fabric which is directed toward the receiver roll 240 eliminates the necessity for using conveyors adjacent the driven rolls and along such path of movement to direct the movement of the fabric after it is cut. To the extent that a fabric may tend to flap slightly away from its vertical path of movement, small air jets 290 may be mounted in the superstructure 224' just above the cutting element 262 on opposite sides of the fabric to assist in maintaining the fabric in its vertical path of movement after it is cut.

Push arms 288, only one of which is visible in FIG. 3, maintain the precise angle of attack to insure proper contact of driven roll 284 to receiver roll 240. Push arms 288 also maintain the proper angle for clearance as arms 224 are raised when the receiver roll 240 is full. Push arms 288 are pivoted on carriage 16 (FIG. 1), and connect at a point on superstructure 224'.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. Apparatus for automatically cutting a travelling sheet of material and feeding the cut edge thereof to a driven receiver roll for winding thereon, said apparatus including:

(a) a frame;

(b) arm means mounted on said frame for selective movement in directions toward and away from said receiver roll;

(c) first and second driven roll means mounted in spaced relation on said arm means in driving contact with said material to move said material along a predetermined path of movement toward said receiver roll, said first driven roll means including engaging means selectively movable to an operative position for positively engaging said traveling material;

(d) cutting means disposed on said arm means between said first and second driven rolls and within said path of material movement for selectively cutting said moving material along an edge extending transversely of the direction of movement thereof;

(e) said second driven roll means being disposed on said arm means to selectively engage said surface of said receiver roll to form a nip therewith, said nip being substantially in said predetermined path of material movement whereby said cut edge of said material will be received by said nip to cause winding of said material about said receiver roll.

2. Apparatus as defined in claim 1 and further characterized in that said arm means is pivotably mounted on carriage means carried on said frame for alternate movement from a position above a substantially full receiver roll to a position above an empty receiver roll, said arm means being movable toward said empty receiver roll to position said second driven roll adjacent said empty receiver roll, and said cutting means being operated to cut said fabric when said second driven roll is adjacent said empty receiver roll.

3. Apparatus as defined in claim 1 and further characterized in that said cutting means including a rotatable blade means rotating at a surface speed corresponding to the speed of said moving material whereby said material is cut during said movement thereof.

4. Apparatus as defined in claim 1 and further characterized in that said first driven roll means includes a rotating roll having surface contact with said material, and in that said engaging means is movable toward said rotating roll to positively engage said moving material therebetween, and in that operating means are provided for selectively moving said engaging means toward said rotating roll to engage said material just prior to said cutting of said material by said cutting means whereby said material is maintained in tension as it is being cut and is directed along said path of movement after being cut.

5. Apparatus as defined in claim 1 and further characterized in that a third driven roller is mounted on said arm means adjacent said second driven roll means to engage said moving material during said movement of said arm means in one of said directions thereof.

6. Apparatus for automatically cutting a traveling sheet of material and feeding the cut edge thereof to a driven receiver roll for winding thereon, said apparatus including:

(a) a frame;

(b) arm means mounted on said frame for selective movement toward and away from said receiver roll;

(c) first and second driven rolls mounted in spaced relation on said arm means in driving contact with said material to move said material along a predetermined path of movement toward said receiver roll, said second driven roll being disposed on said arm means to feed said material onto the surface of said receiver roll;

(d) cutting means disposed between said spaced first and second driven rolls and within said path of material movement for selectively cutting said material along an edge extending transversely of the direction of movement thereof;

(e) first engaging means disposed upstream of said cutting means and selectively movable to an operative position for positively engaging said moving material during said cutting thereof and for guiding said material along said predetermined path of movement; and (f) second engaging means disposed downstream of said cutting means and selectively movable to an operative position for positively engaging said moving material and conveying said material to said receiver roll.

7. Apparatus as defined in claim 6, and further characterized in that said first engaging means comprises a driven conveyor belt disposed adjacent said first driven roll to engage said material therebetween at said operative position thereof.

8. Apparatus as defined in claim 6 and further characterized in that said second engaging means comprises a driven conveyor belt disposed adjacent said second driven roll and selectively movable toward said second driven roll to engage said material therebetween at said operative position thereof.

9. Apparatus as defined in claim 8 and further characterized in that the driven conveyor belt of said second engaging means extends along said predetermined path of material movement at said operative position thereof.

10. Apparatus as defined in claim 9 and further characterized in that said cutting means includes a guide plate having a surface portion across which said material is moved, said surface portion extending along said path of material movement, and in that said driven conveyor belt of said second engaging means is disposed adjacent to said guide plate surface portion in rectilinear alignment therewith at said operative position of said second engaging means.

11. Apparatus as defined in claim 6 and further characterized in that said frame includes a support extending across an area in which a plurality of said receiver rolls are disposed, in that said arm means is mounted on said support for selective movement therealong to position said arm above any one of said receiver rolls, and in that said arm means is mounted on said support for selective pivotal movement toward and away from any one of said receiver rolls.

12. Apparatus for automatically cutting a travelling length of material and feeding the cut edge thereof onto a receiver roll for winding thereon, said apparatus including:

(a) a frame;

(b) arm means mounted on said frame for selective movement in directions toward and away from said receiver roll;

(c) an idler roll, carried on said arm, about which said travelling material is guided;

(d) a driven feeder roll carried on said arm in spaced relation to said idler roll, said driven feeder roll being disposed on said arm to engage said receiver roll to form a nip therewith when said arm is moved toward said receiver roll;

(e) cutting means mounted on said arm means between said idler roll and said driven feeder roll for selectively cutting said travelling material along an edge extending transversely of the direction of travel thereof; and (f) a driven engagement roll disposed adjacent to and normally spaced from said idler roll, said idler roll being mounted on said arm means for selective movement to an operative position at which said material is positively engaged between said idler roll and said driven engagement roll just prior to said cutting of said travelling material by said cutting means.

13. Apparatus as defined in claim 12 and further characterized in that a third driven roll is mounted on said arm adjacent to and spaced from said driven feeder roll for guiding and driving said travelling material during movement of said arm means in one said direction of movement thereof.

14. Apparatus as defined in claim 12 and further characterized in that said driven feeder roll and said driven engagement roll are disposed on said arm means to provide a predetermined path of movement for said travelling material therebetween which is in a substantially vertical direction toward the said nip formed by said feeder roll and said receiver roll when said arm means is moved to a position adjacent to said receiver roll.

15. Apparatus as defined in claim 14 and further characterized in that fluid jet means are disposed on opposite sides of said travelling material just upstream of said cutting means to assist in directing said material along said predetermined path of movement thereof after said material has been cut.

16. Apparatus as defined in claim 12 and further characterized in that said frame includes a support extending across an area in which a plurality of said receiver rolls are disposed, in that said arm means is mounted on said support for selective movement therealong to position said arm above any one of said receiver rolls, and in that said arm means is mounted on said support for selective pivotal movement toward and away from any one of said receiver rolls.

* * * * *